United States Patent [19]

Macintosh

[11] 4,070,933

[45] Jan. 31, 1978

[54] PIPE WRENCH JAW

[76] Inventor: Robert B. Macintosh, 206 Beech Ave., Melrose, Mass. 02176

[21] Appl. No.: 778,356

[22] Filed: Mar. 17, 1977

[51] Int. Cl.[2] ..... B25B 13/58

[52] U.S. Cl. ..... 81/180 B; 81/186

[58] Field of Search ..... 81/186, 183, 180 B, 81/180 R, 57.2, 57.33; 269/231, 235; 24/263 DT, 263 D, 263 A

[56] References Cited

U.S. PATENT DOCUMENTS

| | | | |
|---|---|---|---|
| 2,060,189 | 11/1936 | Foster | 81/57.33 |
| 2,526,167 | 10/1950 | Sparks | 81/186 X |
| 2,528,814 | 11/1950 | Boyer | 81/183 |
| 2,584,353 | 2/1952 | Keiser | 81/186 X |

*Primary Examiner*—Al Lawrence Smith
*Assistant Examiner*—Nicholas P. Godici

[57] ABSTRACT

A pipe wrench jaw adapted to be utilized with a wrench having a pair of jaw members adapted to be moved towards and away from each other. The replaceable jaw comprises a housing member having an upper and lower end spaced from each other and a pair of sides adapted to fit across the width of a jaw member of the wrench with a plurality of grooves extending on the upper end between the sides. Each groove has a front and rear wall extending in spaced relationship to each other and a gripping member is pivotably mounted in each groove between the sides and adapted for angular movement between a forward position and a rearward position between the front and rear wall respectively. Each gripping member includes a plurality of transversely extending teeth formed in an arcuate path having a front end and a rear end with the front end having a greater radius than the rear end so as to obtain a gripping engagement with a pipe or the like contained therebetween with the gripping member adapted to rotate with the movement of the wrench to engage the pipe.

10 Claims, 4 Drawing Figures

PIPE WRENCH JAW

BACKGROUND OF THE INVENTION

This invention relates to wrenches, and particularly to pipe wrenches or the like wherein the jaws are designed to exert a firm grip on a cylindrical or similar object.

The present invention particularly concerns itself with a removable jaw that is easily placed into position and removed without the use of tools, and without reference to retaining means, such as detent means of rigid or spring forms. By providing a jaw of this character it can be conveniently put into position and so designed for biting into and firmly gripping a workpiece which may be cylindrical or of other shape.

OBJECTS OF THE INVENTION

An object of the present invention is to provide a replaceable jaw for use in a pipe wrench and capable of exerting the required force on the pipe to be engaged.

Another object of the present invention is to provide a pipe wrench jaw to be utilized with a wrench having a pair of jaw members adapted to be moved towards and away from each other.

Anoher object of the present invention is to provide a wrench wherein one gripping jaw is readily removable and replaceable.

Another object of the present invention is to provide a pipe wrench jaw that is simple in construction, economical to manufacture, and efficient and reliable in operation.

Other objects and advantages of the present invention will become apparent as the disclosure proceeds.

SUMMARY OF THE INVENTION

The present invention discloses a pipe wrench jaw adapted to be utilized with a wrench having a pair of jaw members adapted to be moved towards and away from each other. The replaceable jaw comprises a housing member having an upper and lower end spaced from each other and a pair of sides adapted to fit across the width of a jaw member of the wrench with a plurality of grooves extending on the upper end between the sides. Each groove having a front and rear wall extending in spaced relationship to each other.

A gripping member is pivotably mounted in each groove between the sides and adapted for angular movement between a forward position and a rearward position between the front and rear wall respectively. Each gripping member includes a plurality of transversely extending teeth formed in an arcuate path having a front end and a rear end. The front end having a greater radius than the rear end so as to obtain a gripping engagement with a pipe or the like contained therebetween with the gripping member adapted to rotate with the movement of the wrench.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
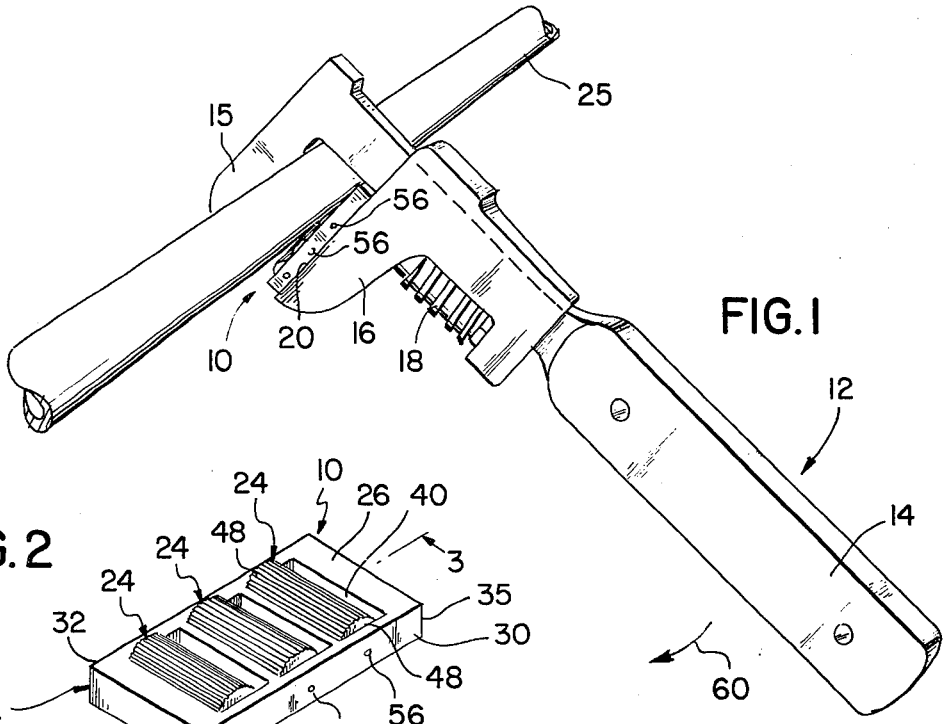
FIG. 1 is a perspective view of a removeable jaw in position on a wrench, in accordance with the present invention.
Figure 2:
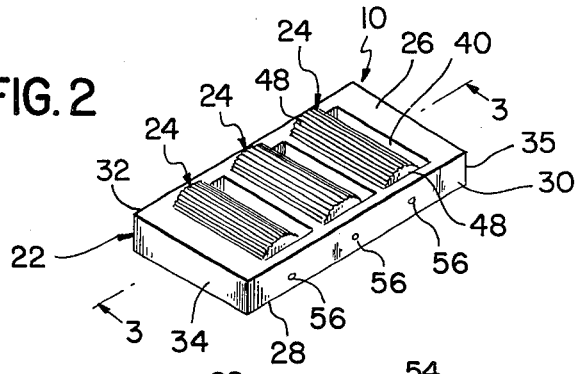
FIG. 2 is a perspective view of the removable jaw of the present invention.

Referring now to the drawings there is illustrated in FIGS. 1–4 a removeable pipe wrench jaw 10 that may be utilized in conjunction with a more or less conventional pipe wrench structure 12 having a handle 14 with a pair of jaw members 15 and 16 adapted to be moved towards and away from each other. A cylindrical member 18 is provided in a manner well known in the art, to move the respective jaws 15 and 16 towards and away from each other. The lower jaw member 16 may include a contacting or mating surface 20 adapted to receive thereon the pipe wrench jaw 10 without the need for any fasteners or other securing means as is commonly the case.

The pipe wrench jaw 10 includes a housing member 22 and a plurality of gripping members 24 which function to grip the workpiece 25, which may be in the form of a cylindrical or otherwise shaped object.

The housing member 22 made from a metallic material, includes an upper end 26 and lower end 28 spaced from each other. The respective ends 26 and 28 define planar surfaces that may be parallel spaced from each other. A pair of sides 30 and 32 defined the side walls of the housing member 22. The sides 30 and 32 fit across the width of jaw member 16 of the wrench 12. The housing member 22 further includes a front face or wall 34 and rear face or wall 35 spaced from each other. The housing member 22 may form a rectangular configuration.

A plurality of grooves 36 extend on the upper end 26 between the sides 30 and 32. Three grooves 36 are illustrated, but two or more may be provided. Each groove 36 includes a front wall 38 and a rear wall 40, that extends in parallel spaced relationship to each other. The groove 36 further includes an inner or lower wall 42 that may be connected to the front wall 38 by an inclined wall 44 and to the rear wall 40 by a curved section 45. In this manner each groove 36 is adapted to receive therein a respective gripping member 24 to function in a particular manner for gripping of the pipe 25 relative thereto.

Each gripping member 24 includes a body portion 46 having spaced apart ends 48 that extend between the respective outer walls 50 of each groove 36. The spacing is such as to permit freedom of angular movement. The body portion 46 includes a front end 52 and a rear end 54 with an arcuate path or curve therebetween. A plurality of transversely extending teeth 55 is provided along the arcuate path between the front end 52 and rear end 54. A transversely extending pin 56 extends through each gripping member 24 and within the housing member 22.

Figure 3:
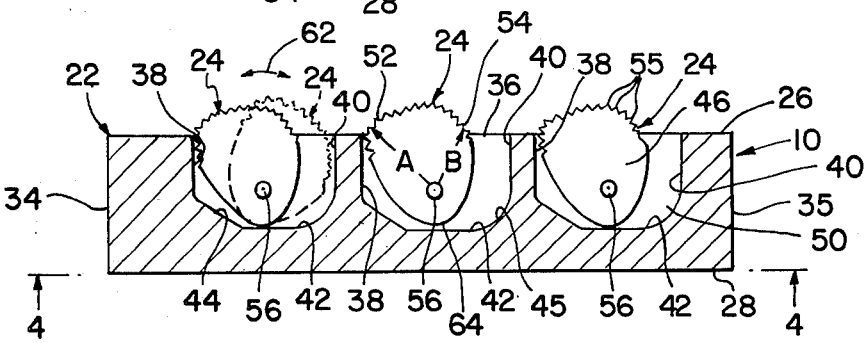
FIG. 3 is a vertical section taken on line 3—3 of FIG. 2.
Figure 4:
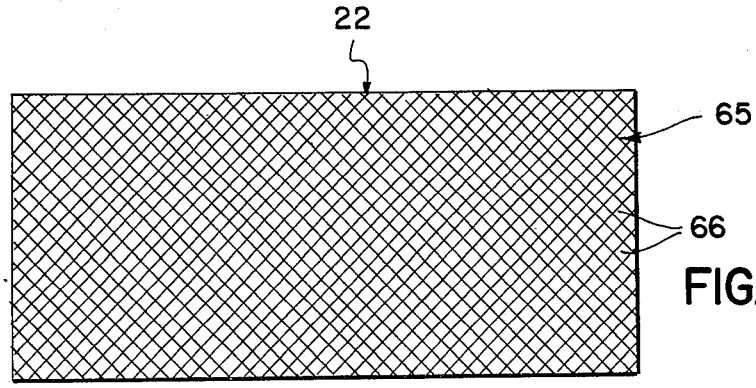
FIG. 4 is a bottom plan view of the removable jaw taken on a line 4—4 of FIG. 3.

The arcuate path between the front end 52 and rear end 54 having the teeth 55 thereon extends above the upper end 26 of the housing member 22. The dimensional relationship of each gripping member 24 is such that the front end illustrated by the radius A is greater than the radius B illustrated at the rear end 54. In this manner a gripping engagement with the pipe 25 is obtained when a torque is applied to the wrench hammer 14 in the direction of arrow 60. When this force is applied and the pipe 25 is positioned adjacent one of the gripping members 24 then angular movement will occur as depicted by the doubleheaded arrow 62. Since each gripping member is pivotably mounted by pin 56, the teeth 55 can grip into the pipe 25. As illustrated in FIG. 3 the normal position of each gripping member 24 is illustrated. When the torque is provided by arrow 60, the gripping member will move to the position illustrated in phantom and abut the rear wall 40.

Each gripping member 24 has a bottom end 64 that extends adjacent the inner wall 42 of each groove 36. This permits the necessary spacing for the angular movement of a respective gripping member 24 when the torque is applied. In operation once the jaws 10 are placed in position the jaw members 15 and 16 are closed around the pipe 25. Now the wrench handle 14 is turned in the direction of arrow 60. The contact between the teeth 55 and the pipe 25, when the wrench 12 is turned, causes the gripping member 24 to rotate around the pin 56 in a clockwise direction. Now, due to the shape of the gripping member 24, the distance of radius A at the front end 52 being greater than the distance of radius B at the rear end 54, the wedging engagement is obtained.

Accordingly, the teeth 55 bite into the pipe 25 with more and more force. This enables the wrench 12 to turn the pipe 25 rather than rotate helplessly around it. Each gripping member 24 may be produced from a hard steel.

To permit the jaw 10 to be readily inserted and removed, gripping or friction means 65 may be employed with the housing member 22. The gripping means 65 may take the form of a grooved surface 66 contained on the lower end 28 of the housing member 22. The grooved surface may be in a diagonal configuration and performs the function of gripping the surface 20 of jaw member 16 so that a permanent fastener is not required.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A pipe wrench jaw adapted to be utilized with a wrench having a pair of jaw members adapted to be moved towards and away from each other, said jaw comprising:

a. a housing member having an upper and lower end spaced from each other and a pair of sides adapted to fit across the width of a jaw member with a plurality of grooves extending on said upper end between said sides, each said groove having a front and rear wall extending in spaced relationship to each other, and b. a gripping member pivotably mounted in each said groove between said sides and adapted for angular movement between a forward position and a rearward position between said front and rear wall respectively, each said gripping member including a plurality of transversely extending teeth formed in an arcuate path having a front end and a rear end, said front end having a greater radius than said rear end so as to obtain a gripping engagement with a pipe or the like contained therebetween with said gripping member adapted to rotate with the movement of the wrench.

2. A pipe wrench jaw as in claim 1, wherein said teeth extend between the width of each gripping member defined by spaced apart end walls.

3. A pipe wrench jaw as in claim 2, wherein said arcuate path of teeth at the front end thereof extends in said groove below said upper end.

4. A pipe wrench jaw as in claim 2, wherein said arcuate path of teeth at the rear end thereof extends in said groove below said upper end.

5. A pipe wrench jaw as in claim 1, and further including a pin extending transversely through each said gripping member and into said housing member for pivotably mounting each said gripping member in a respective groove.

6. A pipe wrench jaw as in claim 1, wherein each said groove includes said front and rear wall extending in substantially parallel relationship to each other.

7. A pipe wrench jaw as in claim 1, wherein each said gripping member includes a body portion with said teeth at one end thereof, and said body portion extends inwardly from said front and rear end to a bottom end adjacent the inner wall of said groove.

8. A pipe wrench jaw as in claim 1, and further including gripping means on said lower end of said housing member to facilitate frictional engagement with a jaw member when said jaw is mounted relative to a wrench.

9. A pipe wrench jaw as in claim 8, wherein said gripping means includes a grooved surface on said lower end to provide the degree of frictional resistance required.

10. A pipe wrench jaw as in claim 1:

a. wherein said arcuate path of said teeth at said front end and said rear end of said gripping member extend below said upper end of said housing member, b. wherein each said groove includes said front and rear wall extending in substantially parallel relationship to each other and terminating in an inner wall, c. wherein each said gripping member includes a body portion with said teeth at one end thereof, and said body portion extends inwardly from said front and rear end to a bottom end adjacent said inner wall of said groove, and d. further including gripping means on said lower end of said housing member to facilitate frictional engagement with a jaw member when said jaw is mounted relative to a wrench.

* * * * *